US006321920B1

(12) United States Patent
Pan

(10) Patent No.: US 6,321,920 B1
(45) Date of Patent: Nov. 27, 2001

(54) ROTATABLE RACK

(75) Inventor: Chia-Cheng Pan, Chan Hua Hsien (TW)

(73) Assignee: Sun Tai Bathroom Equipment Company, Ltd., Chan Hua Hsien (TW)

( * ) Notice: Subject to any disclaimer, the term of this patent is extended or adjusted under 35 U.S.C. 154(b) by 0 days.

(21) Appl. No.: 09/395,107

(22) Filed: Sep. 14, 1999

(51) Int. Cl.[7] ..... A47F 5/08; A47F 5/13

(52) U.S. Cl. ..... 211/96; 211/168; 211/100; 211/16

(58) Field of Search ..... 211/96, 168, 100, 211/104, 16, 105.2

(56) References Cited

U.S. PATENT DOCUMENTS

| | | | | |
|---|---|---|---|---|
| 136,905 | * | 3/1873 | Danner | 211/104 |
| 207,132 | * | 8/1878 | Reed | 211/96 |
| 419,414 | * | 1/1890 | Campbell | 248/290.1 |
| 571,184 | * | 11/1896 | Bamford | 211/105.2 |
| 586,080 | * | 7/1897 | Thompson | 211/123 |
| 648,760 | * | 5/1900 | Kolb | 160/330 |
| 844,514 | * | 2/1907 | Gillmore | 211/96 |
| 1,697,866 | * | 1/1929 | Hansen | 211/165 |
| 1,926,636 | * | 9/1933 | Subick | 248/251 |
| 2,950,822 | * | 8/1960 | Cope | 211/104 |
| 2,987,193 | * | 6/1961 | Pajor | 211/89.01 |
| 3,159,281 | * | 12/1964 | Hutter et al. | 211/45 |
| 6,158,360 | * | 12/2000 | Cheng | 108/103 |

FOREIGN PATENT DOCUMENTS

| | | | | |
|---|---|---|---|---|
| 105219 | * | 9/1938 | (AU) | 211/96 |
| 157850 | * | 8/1951 | (AU) | 211/105.2 |
| 710752 | * | 6/1931 | (FR) | 211/96 |
| 1056472 | * | 10/1953 | (FR) | 211/105.2 |
| 1075211 | * | 7/1967 | (GB) | 211/96 |

* cited by examiner

*Primary Examiner*—Gregory J. Strimbu
(74) *Attorney, Agent, or Firm*—Jiawei Huang; J. C. Patents

(57) ABSTRACT

A rotatable rack comprising a U-shaped fastening member having a first arm and a second arm each pivotally coupled to first and second L-shaped rods, respectively, by first and second fastening bolts, respectively. The fastening member is fastened onto a wall with a fastening seat and each of the arms is provided with a sunken hole having an inner threaded section. Each fastening bolt includes an outer threaded section at one end thereof which is threadably engaged with a respective one of the inner threaded sections. Each L-shaped rod is provided with a fitting hole at one end portion thereof in which the other end of a respective one of the fastening bolts is fitted into.

6 Claims, 6 Drawing Sheets

ROTATABLE RACK

FIELD OF THE INVENTION

The present invention relates to a rotatable rack.

BACKGROUND OF THE INVENTION

As shown in FIG. 1, a rotatable rack of the prior art comprises a fastening head 4 which is fastened onto a wall, and two holding rods 2 which are rotatably fastened at one end thereof with the fastening head 4 by a fastening bolt 5. The fastening end of each of the two holding rods 2 is provided with a retaining body 1 which is fastened with the fastening head 4 by the fastening bolt 5 in conjunction with a collar 3. The holding rod 2 and the retaining body 1 can be rotated together with the fastening bolt 5 serving as a pivot.

Such a prior art rotatable rack as described above is poorly designed in terms of its esthetic effect and its production efficiency.

SUMMARY OF THE INVENTION

The primary objective of the present invention is therefore to provide a rotatable rack that is free from the drawbacks of the prior art rotatable rack described above.

In keeping with the principle of the present invention, the foregoing objective of the present invention is attained by a rotatable rack comprising a U-shaped fastening member which is provided in the free end of both arms thereof with a threaded hole that is engaged with one end of a fastening bolt. The U-shaped fastening member is provided with two L-shaped rods, with each being rotatably fastened with the free end of the U-shaped fastening member. The two L-shaped rods are used for holding towels and the like and are located in a coplanar manner. All fastening bolts are concealed so as to enhance the esthetic effect of the present invention.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
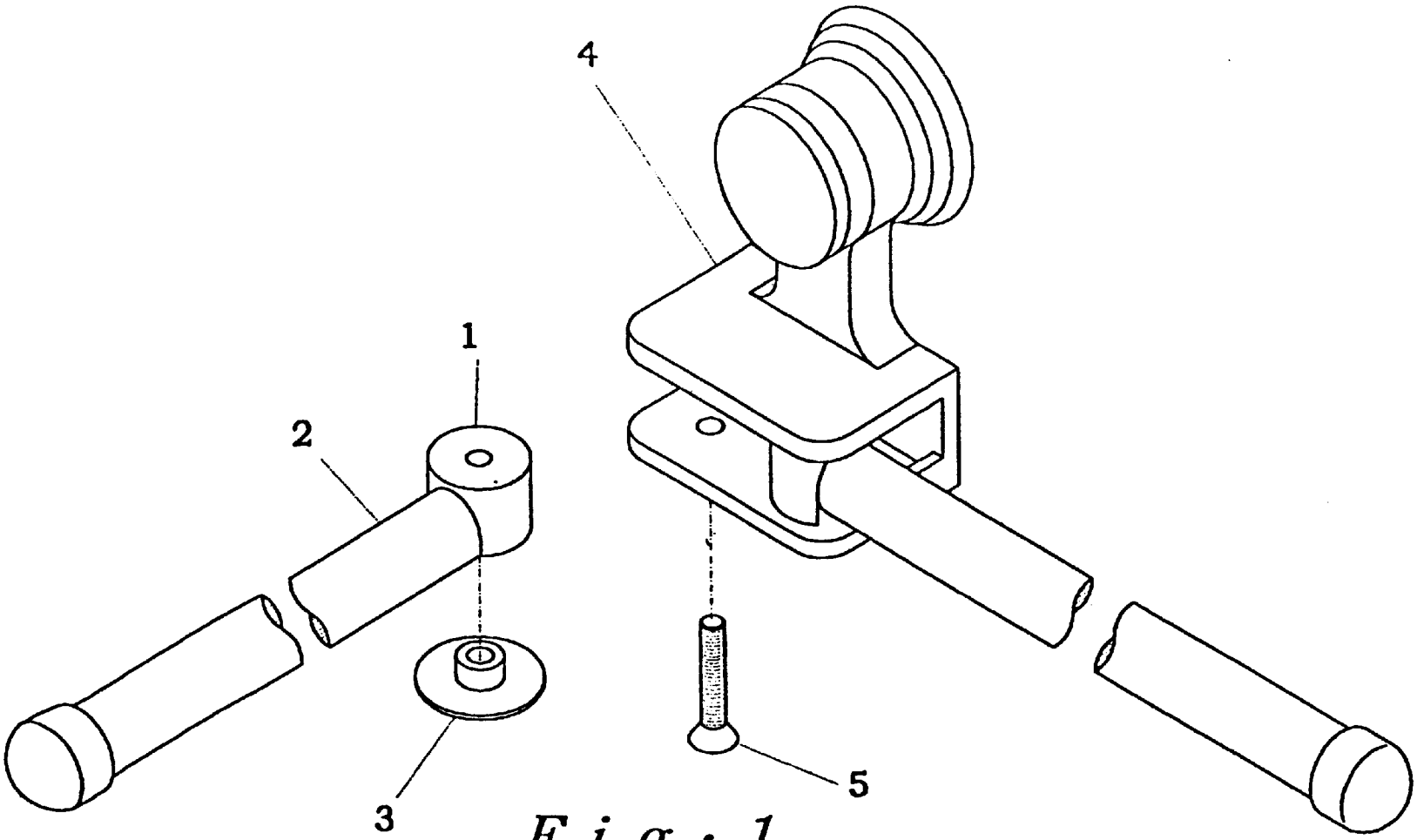
Fig. 1 PRIOR ART
FIG. 1 shows a schematic view of a rotatable rack of the prior art.
Figure 2:
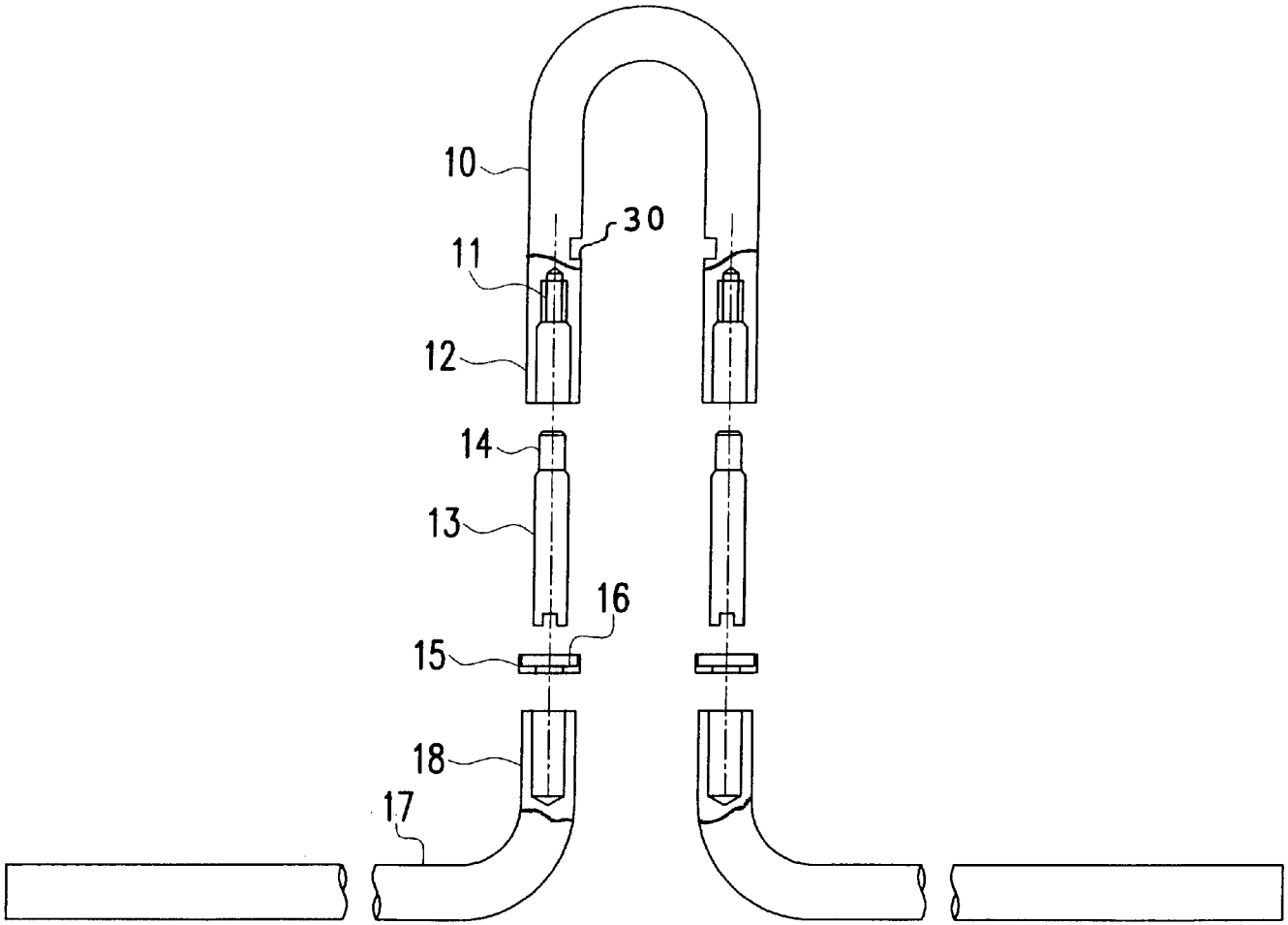
FIG. 2 shows an exploded view of the present invention.
Figure 3:
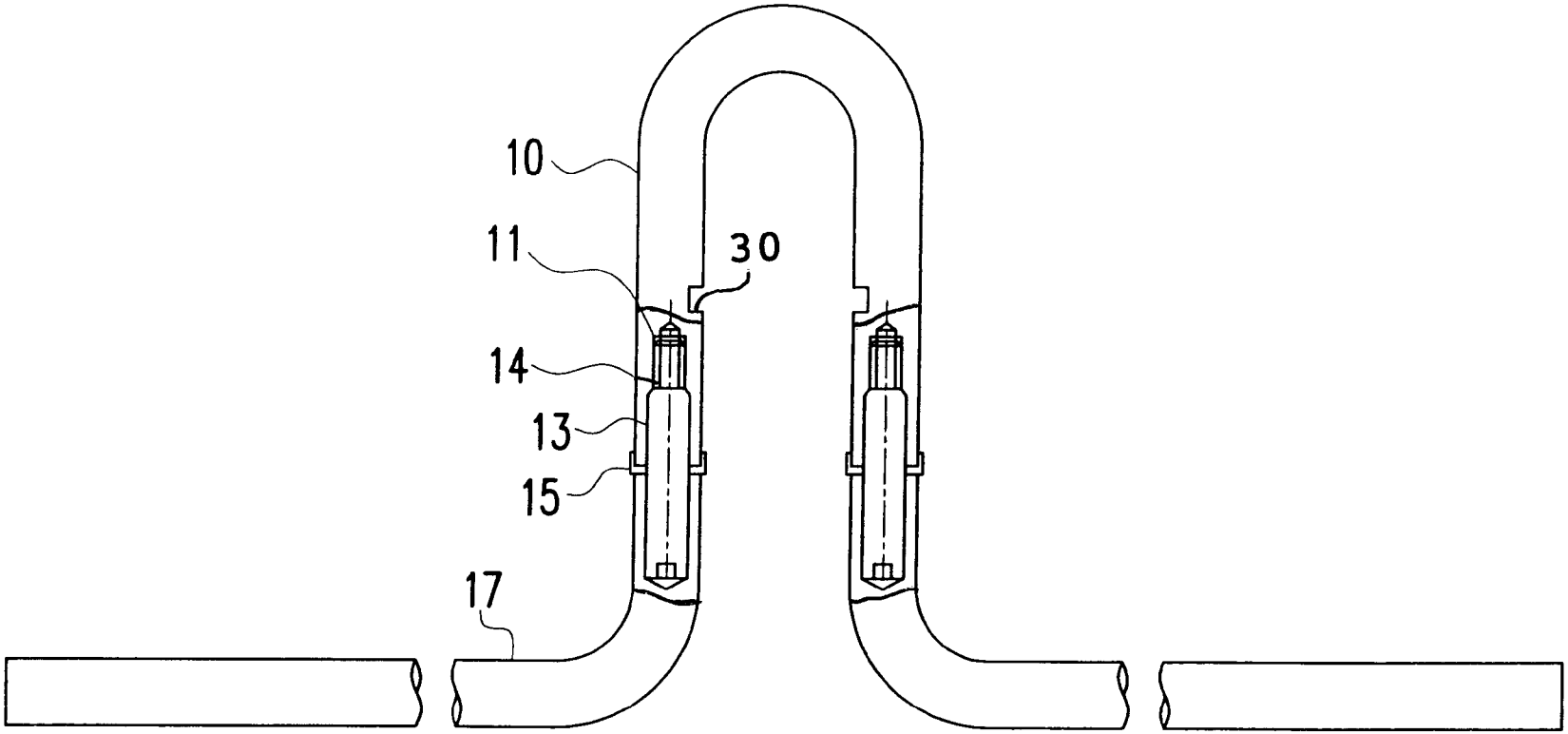
FIG. 3 shows a sectional view of the present invention.

As shown in FIGS. 2 and 3, a rotatable rack embodied in the present invention comprises a U-shaped fastening member 10, and two L-shaped rods 17 which are rotatably fastened at one end thereof with the free ends of two arms of the U-shaped fastening member 10. Each of the two free ends of the arms of the fastening member 10 is provided with a sunken hole 12 of a predetermined depth and having an inner threaded section 11. Each of the two arms of the U-shaped fastening member 10 also has a slot 30 formed thereon. As shown in FIGS. 2 and 3 as well as FIG. 4, the slot 30 is substantially perpendicular to the longitudinal axis of the arm.

Each of the two L-shaped rods 17 is provided at the fastening end thereof with a fitting hole 18. The L-shaped rod 17 is fastened with one of the two free ends of the U-shaped fastening member 10 by a fastening bolt 13 which is provided at one end thereof with an outer threaded section 14 that is engaged with the inner threaded section 11. The fastening bolt 13 is fitted at the other end thereof into the fitting hole 18 of the L-shaped rod 17 in conjunction with a ring 15 which is intended to conceal the junction of the fastening member 10 and the L-shaped rod 17 and is provided with a stepped hole 16. Each of the two L-shaped rods 17 can be rotated around the fastening bolt 13 with the fastening bolt 13 serving as a pivot.

Figure 4:
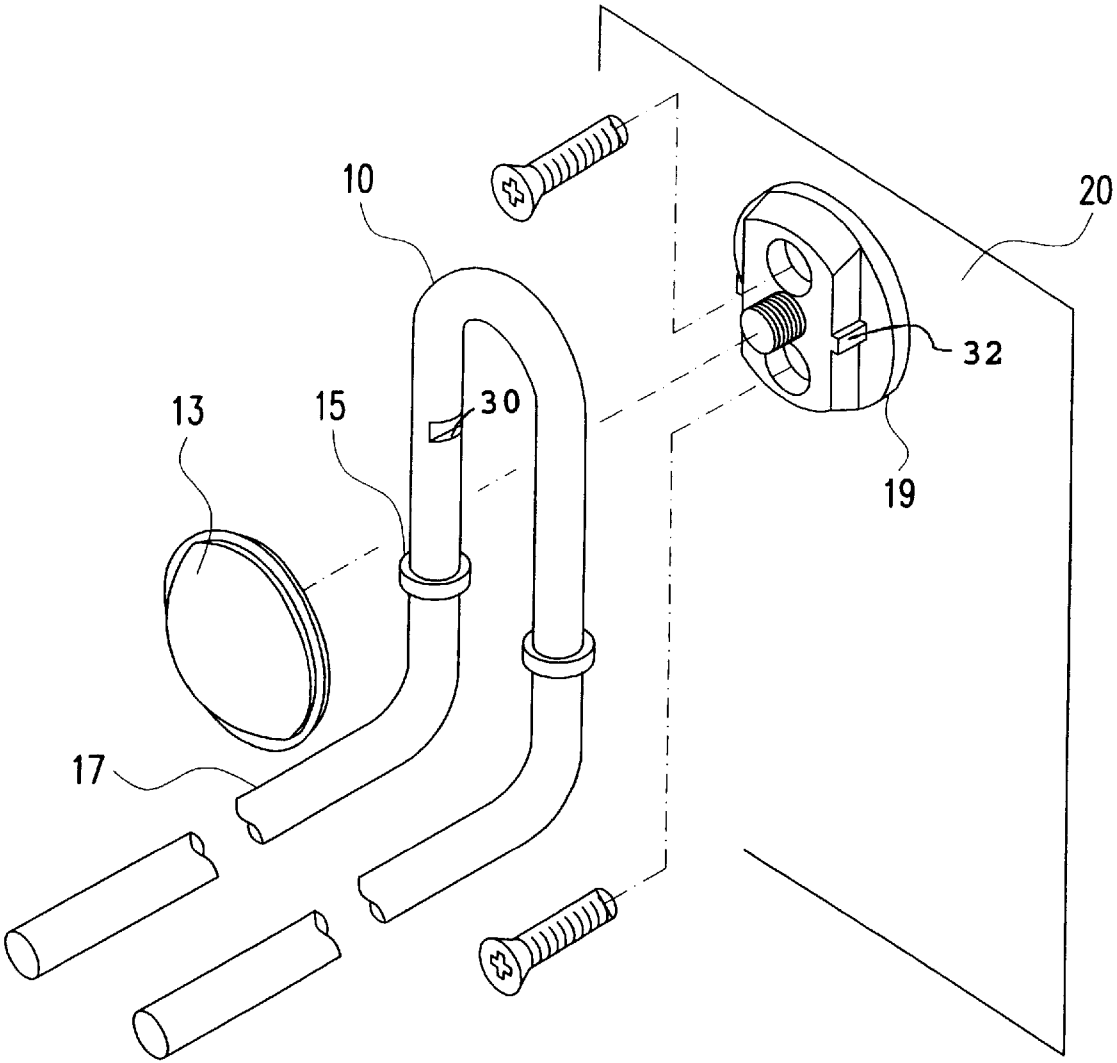
FIG. 4 is a schematic view to show that the present invention is fastened onto a wall.

As shown in FIG. 4, a rotatable rack of the second preferred embodiment of the present invention is provided with a fastening seat 19, which is fastened onto a wall 20 and is intended to retain the fastening member 10. The fastening seat 19 is provided with a cover 13 for concealing the fastening seat 19. The fastening seat 19 is also provided with two protrusions 32 for engaging with the slots 30. The maximum turning angle of the L-shaped rods 17 is 180 degrees. The two L-shaped rods 17 are located in a coplanar manner to prevent them from interfering with each other.

Figure 5:
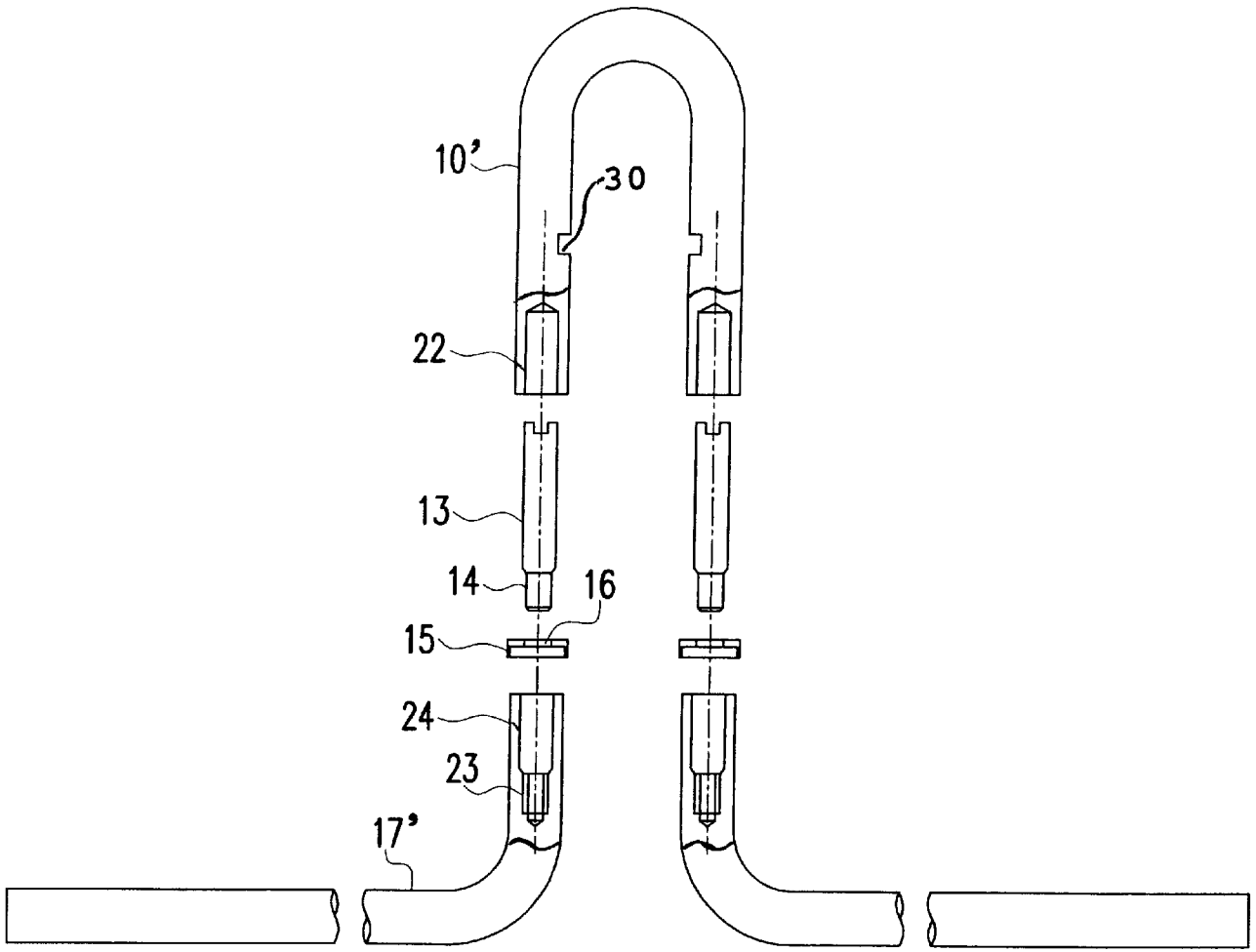
FIG. 5 shows an exploded view of a second preferred embodiment of the present invention.
Figure 6:
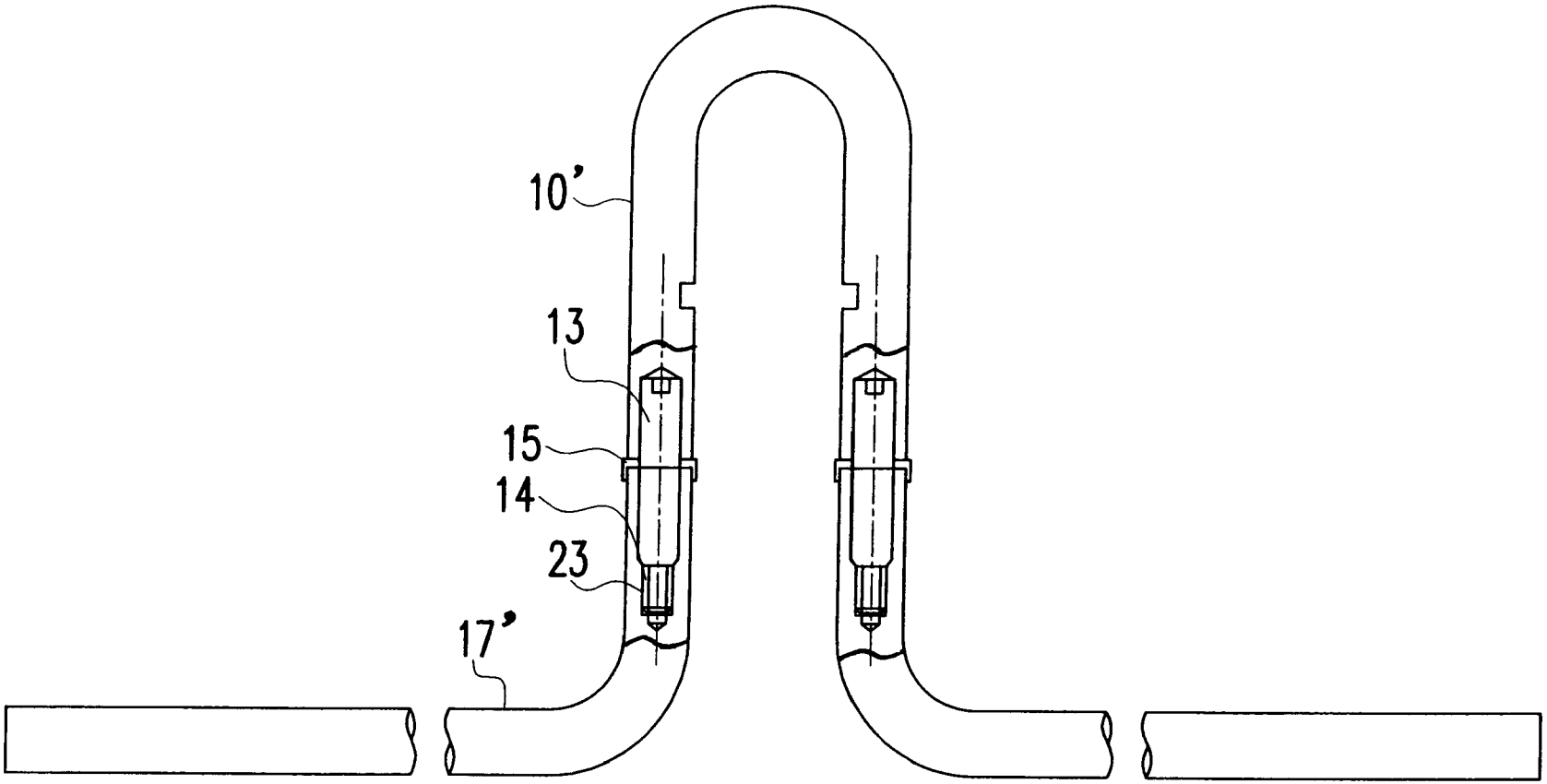
FIG. 6 shows a sectional view of the second preferred embodiment of the present invention.

Now referring to FIGS. 5 and 6, a fastening member 10' is shown to comprise two fitting holes 22. The fastening end of an L-shaped rod 17' is provided with a sunken hole 24 having an inner threaded section 23, which is engaged with the outer threaded section 14 of the fastening bolt 13. The ring 15 is located at the junction of the fastening member 10' and the L-shaped rod 17'.

What is claimed is:

1. A rotatable rack comprising:

a U-shaped fastening member having two elongated arms, each of the arms being provided with a sunken hole having an inner threaded section, wherein each said sunken hole is formed along a longitudinal axis of a corresponding one of the elongated arms;

a plurality of fastening bolts, each said fastening bolt provided at one end thereof with an outer threaded section which is engaged with a respective one of said inner threaded sections; and a plurality of L-shaped rods, each said rod provided at one end portion thereof with a fitting hole which is rotatably fastened to the other end of a respective one of said fastening bolts such that said other end of said respective one of said fastening bolts is fitted into said fitting hole of said L-shaped rod, wherein each said fitting hole is formed along a longitudinal axis of said one end portion of a respective one of the L-shaped rods.

2. The rotatable rack as defined in claim 1, wherein said fastening member is retained by a fastening seat.

3. The rotatable rack as defined in claim 1 further comprising plurality of rings, each said ring is provided with a stepped hole and is used to conceal a junction of a respective one of said arms of said fastening member and a respective one of said L-shaped rods.

4. A rotatable rack comprising:

a fastening member having a first arm and a second arm, each of the two arms being provided at one end with a sunken hole having an inner threaded section, wherein each sunken hole is formed along a longitudinal axis of a respective one of the arms;

a first fastening bolt provided at one end thereof with an outer threaded section for engaging with the inner threaded section of the first arm;

a second fastening bolt provided at one end thereof with an outer threaded section for engaging with the inner threaded section of the second arm;

a first L-shaped rod provided at one end portion thereof with a first fitting hole for receiving the other end of the first fastening bolt such that, when in use, said other end of the first fastening bolt is inserted into the first fitting hole and defines a first pivotal axis, wherein the first L-shaped rod is rotatable around the first pivotal axis and the first fitting hole is formed along a longitudinal axis of said one end portion of the first L-shaped rod;

a second L-shaped rod provided at one end portion thereof with a second fitting hole for receiving the other end of the second fastening bolt such that, when in use, said other end of the second fastening bolt is inserted into the second fitting hole and defines a second pivotal axis, wherein the second L-shaped rod is rotatable around the second pivotal axis and the second fitting hole is formed along a longitudinal axis of said one end portion of the second L-shaped rod; and a fastening seat having a first protrusion and a second protrusion, wherein the first arm has a first slot positioned substantially perpendicular to the longitudinal axis of the first arm, the second arm has a second slot positioned substantially perpendicular to the longitudinal axis of the second arm and, when in use, the first slot is engaged with the first protrusion and the second slot is engaged with the second protrusion so that the fastening member is held onto the fastening seat.

5. The rotatable rack as defined in claim 4, wherein the fastening member comprises a U-shaped rod defining the first arm and the second arm.

6. The rotatable rack as defined in claim 4, further comprising a first ring and a second ring, wherein the first ring is provided with a stepped hole and is used to conceal a junction between the first arm and the first L-shaped rod, the second ring is provided with a stepped hole and is used to conceal a junction between the second arm and the second L-shaped rod.

* * * * *